US008590267B2

(12) United States Patent
Jaffee

(10) Patent No.: US 8,590,267 B2
(45) **Date of Patent: *Nov. 26, 2013**

(54) METHODS OF PROVIDING WATER PROTECTION TO ROOF STRUCTURES AND ROOF STRUCTURES FORMED BY THE SAME

(75) Inventor: Alan Michael Jaffee, Bowling Green, OH (US)

(73) Assignee: Johns Manville, Denver, CO (US)

( * ) Notice: Subject to any disclaimer, the term of this patent is extended or adjusted under 35 U.S.C. 154(b) by 1693 days.

This patent is subject to a terminal disclaimer.

(21) Appl. No.: 10/938,826

(22) Filed: Sep. 10, 2004

(65) Prior Publication Data

US 2006/0053737 A1 Mar. 16, 2006

(51) Int. Cl.
*E04B 1/00* (2006.01)
*E04G 21/00* (2006.01)
*E04G 23/00* (2006.01)

(52) U.S. Cl.
USPC ..... 52/746.11; 52/408; 52/309.4; 52/518; 52/302.3; 428/114; 428/314.4

(58) Field of Classification Search
USPC ..... 52/408, 518, 743.11, 309.4, 302.1, 199, 52/95, 302.3, 410, 741.3, 746.11; 428/114, 106, 314.4, 292.4, 292.7
See application file for complete search history.

(56) References Cited

U.S. PATENT DOCUMENTS

| | | | | | |
|---|---|---|---|---|---|
| 3,760,856 | A * | 9/1973 | Kough et al. | 144/345 |
| 4,189,878 | A * | 2/1980 | Fitzgerald | 52/95 |
| 4,450,663 | A * | 5/1984 | Watkins | 52/309.4 |
| 4,507,901 | A * | 4/1985 | Carroll | 52/302.3 |
| 4,587,164 | A * | 5/1986 | Freeman | 428/314.4 |
| 4,810,576 | A * | 3/1989 | Gaa et al. | 428/391 |
| 4,852,314 | A * | 8/1989 | Moore, Jr. | 52/199 |
| 5,099,627 | A * | 3/1992 | Coulton et al. | 52/408 |
| 5,837,620 | A * | 11/1998 | Kajander | 442/63 |
| 5,937,620 | A * | 8/1999 | Chalendar | 53/566 |
| 6,303,207 | B1 * | 10/2001 | Kajander | 428/106 |
| 6,331,339 | B1 * | 12/2001 | Kajander | 428/114 |
| 6,594,965 | B2 * | 7/2003 | Coulton | 52/302.1 |
| 6,804,922 | B1 * | 10/2004 | Egan | 52/408 |

* cited by examiner

*Primary Examiner* — Chi Q Nguyen
(74) *Attorney, Agent, or Firm* — Robert D. Touslee

(57) ABSTRACT

The present invention relates to methods of providing water protection to roof structures as well as the improved roof structures formed by the methods. The methods comprise providing one or more water resistant roof sheathing panels and installing the roof sheathing panel(s) on a roof structure of a building. Each of the roof sheathing panels comprises a wood sheet product and a nonwoven fabric mat adhered to at least one side of the wood sheet product.

19 Claims, 13 Drawing Sheets

Figure 1

| Test Property | | | OSB-FAF/water repellant Prepreg Glass Mats | | | OSB-PF Prepreg Glass Mats | | | OSB-PF Spunbond Mats | | | OSB-FAF Prepreg Glass Mats | | | OSB Baseline (control) | |
|---|---|---|---|---|---|---|---|---|---|---|---|---|---|---|---|---|
| | | CSA Standard minimum for OSB | Results | sd | Improved | Results | sd | Improved | Results | sd | Improved | Results | sd | Improved | Results | sd |
| Modulus of rupture (psi) | Para | 4200 | 5460 | 602.1 | FALSE | 5520 | 416.1 | FALSE | 6310 | 664.3 | FALSE | 6180 | 670.2 | FALSE | 6010 | 601.7 |
| | Perp | 1800 | 3990 | 674.4 | FALSE | 4490 | 997.1 | TRUE | 4530 | 1025.1 | TRUE | 3990 | 324.7 | TRUE | 3270 | 404.9 |
| | | variation | | | FALSE | | | FALSE | | | FALSE | | | FALSE | | |
| Modulus of elasticity (psi) | Para | 800 | 1085 | 99.4 | FALSE | 1126 | 50 | FALSE | 1126 | 115.2 | FALSE | 1135 | 111.6 | FALSE | 1269 | 142.3 |
| | Perp | 225 | 568 | 83.8 | TRUE | 607 | 106.7 | TRUE | 505 | 73 | FALSE | 535 | 34.4 | TRUE | 423 | 59.7 |
| | | variation | | | FALSE | | | TRUE | | | FALSE | | | FALSE | | |
| Internal bond (psi) | | 50 | 35 | 7.54 | FALSE | 41.7 | 9.47 | FALSE | 51.1 | 11.23 | FALSE | 48.6 | 9.73 | FALSE | 53.4 | 10.35 |
| Bond durability – MOR - after 2 hour boil (psi) | Para | 2100 | 1810 | 319.7 | FALSE | 2140 | 170.1 | FALSE | 2790 | 397.6 | FALSE | 2470 | 270.6 | FALSE | 2330 | 290.6 |
| | Perp | 900 | 1630 | 338 | FALSE | 1730 | 349.8 | FALSE | 2130 | 288.9 | TRUE | 2030 | 349.9 | TRUE | 1400 | 260.2 |
| Thickness swell - 24 h soak (%) | | 15 | 7.6 | 1.45 | TRUE | 7.8 | 1.71 | TRUE | 6.9 | 0.97 | TRUE | 6.6 | 0.82 | TRUE | 12 | 0.6 |
| Water absorption - 24 h soak (%) | | N/A | 18.6 | 2.32 | TRUE | 19.1 | 1.33 | TRUE | 20.1 | 2.04 | TRUE | 17.3 | 0.98 | TRUE | 23.6 | 0.87 |
| Linear expansion oven dry to saturated (%) | Para | 0.35 | 0.25 | 0.011 | FALSE | 0.25 | 0.017 | FALSE | 0.23 | 0.031 | FALSE | 0.2 | 0.037 | FALSE | 0.21 | 0.03 |
| | Perp | 0.5 | 0.28 | 0.021 | TRUE | 0.31 | 0.02 | FALSE | 0.33 | 0.027 | FALSE | 0.27 | 0.026 | TRUE | 0.34 | 0.012 |
| Water Vapor Transmission (perm) | | N/A | 0.713 | 0.096 | FALSE | Not Tested | | | 0.532 | 0.079 | FALSE | 0.706 | 0.161 | FALSE | 0.69 | 0.16 |

Figure 2

Summary of Test Results

| | OSB-FAF/water repellant prepreg Glass Mats | OSB-PF Prepreg Glass Mats | OSB-PF Spunbond Mats | OSB-FAF Prepeg Glass Mats |
|---|---|---|---|---|
| MOR parallel force | | | | |
| MOR perpendicular | | X | X | X |
| MOE parallel force | | | | |
| MOE perpendicular force | X | X | | X |
| MOR post 2-hour boil parallel force | | | | |
| MOR post 2-hour boil perpendicular force | | | X | X |
| Internal bond | | | | |
| Thickness Swell | X | X | X | X |
| Water absorption | X | X | X | X |
| Linear expansion parallel force | | | | |
| Linear expansion perpendicular | X | | | X |

X= statistically significant improved performance vs. control sample

METHODS OF PROVIDING WATER PROTECTION TO ROOF STRUCTURES AND ROOF STRUCTURES FORMED BY THE SAME

BACKGROUND OF THE INVENTION

1. Field of the Invention

The present invention generally relates to methods of providing improved roof deck sheets with increased water protection and increased flatness and the roof structures formed by such methods.

2. Description of the Related Art

Current methods for constructing roof structures of buildings such as residential homes include attaching roof sheathing such as plywood or oriented strand board (OSB) to a roof frame. Water sheathing underlayments (e.g., felt paper) are typically placed on top of the roof sheathing in order to impede water leakage. A roofing material such as asphalt shingles is then installed over these underlayments. These underlayments provide temporary weatherization of the roof until the shingles are installed, typically within a few days. In most climates, protection of the wood roof deck must be accomplished as soon as possible to keep the wood decking dry and minimize the chance of rain wetting the decking and causing swelling and warping.

It would be desirable to provide other methods for protecting roof structures from water as well as the roof structures produced by such methods.

SUMMARY OF THE INVENTION

In one aspect, a method of providing water protection to a roof structure of a building is provided. The method comprises (a) providing one or more water resistant roof sheathing panels, each panel comprising a wood sheet product and a nonwoven fabric mat adhered to the wood sheet product, and (b) installing the roof sheathing panel(s) on a roof structure of a building such that the nonwoven mat of each panel faces outwardly from the building. Each roof sheathing panel is produced by subjecting a wood sheet product and a "B" stage condition nonwoven fabric mat to sufficient heat and pressure to complete the cure of the binder in the mat and to adhere the mat to the wood sheet product, the "B" stage condition mat comprising fibers bonded together with a resin binder that is only partially cured.

In another aspect, a roof structure of a building is provided that comprises a plurality of water resistant roof sheathing panels attached to a roof frame of a building as a base layer. Each panel comprises a wood sheet product and a nonwoven fabric mat adhered to the wood sheet product; each roof sheathing panel is produced by subjecting a wood sheet product and a "B" stage condition nonwoven fabric mat to sufficient heat and pressure to complete the cure of the binder in the mat and to adhere the mat to the wood sheet product, the "B" stage condition mat comprising fibers bonded together with a resin binder that is only partially cured. The nonwoven mat of each panel faces outwardly from the building, and a roofing material is attached over the nonwoven mats of the base layer of roof sheathing panels.

In a further aspect, a method of providing water protection to a roof structure of a building is provided that comprises (a) providing one or more water resistant roof sheathing panels, each panel comprising a wood sheet product, a nonwoven fabric mat (consisting of a binder and fibers) adhered to the wood sheet product, and an organic waterproof coating adhered to the nonwoven fabric mat; and (b) installing the roof sheathing panel(s) on a roof structure of a building such that the coated mat of each panel faces outwardly from the building.

In yet another aspect, a roof structure of a building is provided that comprises a plurality of water resistant roof sheathing panels attached to a roof frame of a building as a base layer. Each panel comprises a wood sheet product, a nonwoven fabric mat (consisting of a binder and fibers) adhered to the wood sheet product, and an organic waterproof coating adhered to the nonwoven fabric mat, with the waterproof coating of each panel facing outwardly from the building. A roofing material is attached over the coated mats of the base layer of roof sheathing panels.

Further, the upper nonwoven surface of the roof deck panels can include an antislip treatment to enhance traction and minimize workers from slipping off a sloped roof. Roof decking materials are used in low slope (roof pitch of 3:12 or lower) and steep slope applications (roof pitch higher than 3:12). Therefore, it is desirable to provide a top surface that will be anti-skid so that installers of the roof and materials such as felts, underlayments, tiles or shingles stored on the roof top during installation do not slide off the roof.

In yet a further aspect, a method of providing water protection to a roof structure of a building is provided comprising the steps of (a) providing one or more water resistant roof sheathing panels, each panel comprising a wood sheet product and a nonwoven fabric mat adhered to the wood sheet product and (b) installing the roof sheathing panel(s) on a roof structure of a building such that the nonwoven mat of each panel faces outwardly from the building. Each panel is produced by (1) forming a composite mat comprising: (i) a mat formed from a furnish comprising wood particles and a binder, the mat having a first face and a second face; and (ii) a nonwoven fabric mat contacting the first face of the mat formed from the furnish; and (2) subjecting the composite mat to sufficient heat and pressure to form a roof sheathing panel comprising a wood sheet product having a first face, a second face, and edges with the nonwoven fabric mat adhered to the first face of the wood sheet product.

BRIEF DESCRIPTION OF THE DRAWINGS

FIG. 1 illustrates the results of testing, for various properties, four types of test boards comprising oriented strand board with different nonwoven fabric mat facings as well as an OSB control as explained below.

FIG. 2 illustrates a summary of the test results from FIG. 1.

DETAILED DESCRIPTION OF PREFERRED EMBODIMENTS

The present invention relates to methods of providing water protection to roof structures as well as the improved roof structures formed by the methods.

In general, the methods comprise providing one or more water resistant roof sheathing/underlayment panels and installing the panel(s) on a roof structure of a building. Each of the roof sheathing panels comprises a wood sheet product and a nonwoven fabric mat adhered to at least one side of the wood sheet product. As explained below, the nonwoven fabric mats of the roof sheathing panels provide water resistance to the sheathing panels and therefore to the roof structures and buildings in which they are installed. That is, the nonwoven fabric mats provide water protection to the wood sheet product of the roof sheathing panels themselves, and the water resistant roof sheathing panels provide water protection to the rest of the roof structure by impeding water migration (e.g., from above to below the roof sheathing panels). In some embodiments, the roof sheathing panels may include a nonwoven fabric mat adhered to two sides of the wood sheet product (e.g., to opposing faces of the wood sheet product).

Figure 3:
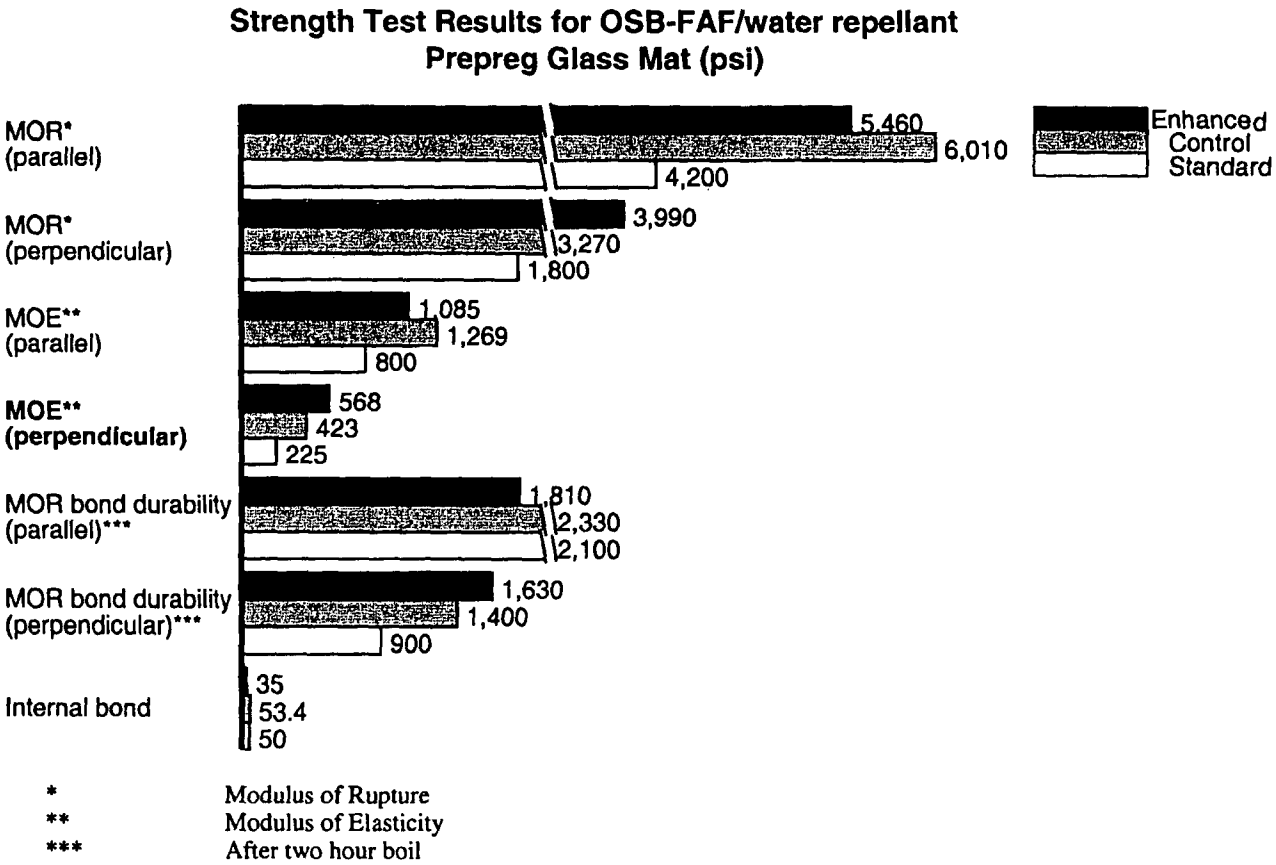
FIG. 3 illustrates the strength test results for boards comprising OSB with glass mat facings that were made using furfuryl alcohol formaldehyde (FAF) binder with an added water repellant (referred to in the figure as "Enhanced"). The figure also illustrates comparative results for an OSB control ("Control") that was tested as well as the Canadian Standards Association (CSA) minimum standards ("Standard") for OSB for each of the tests.
Figure 4:
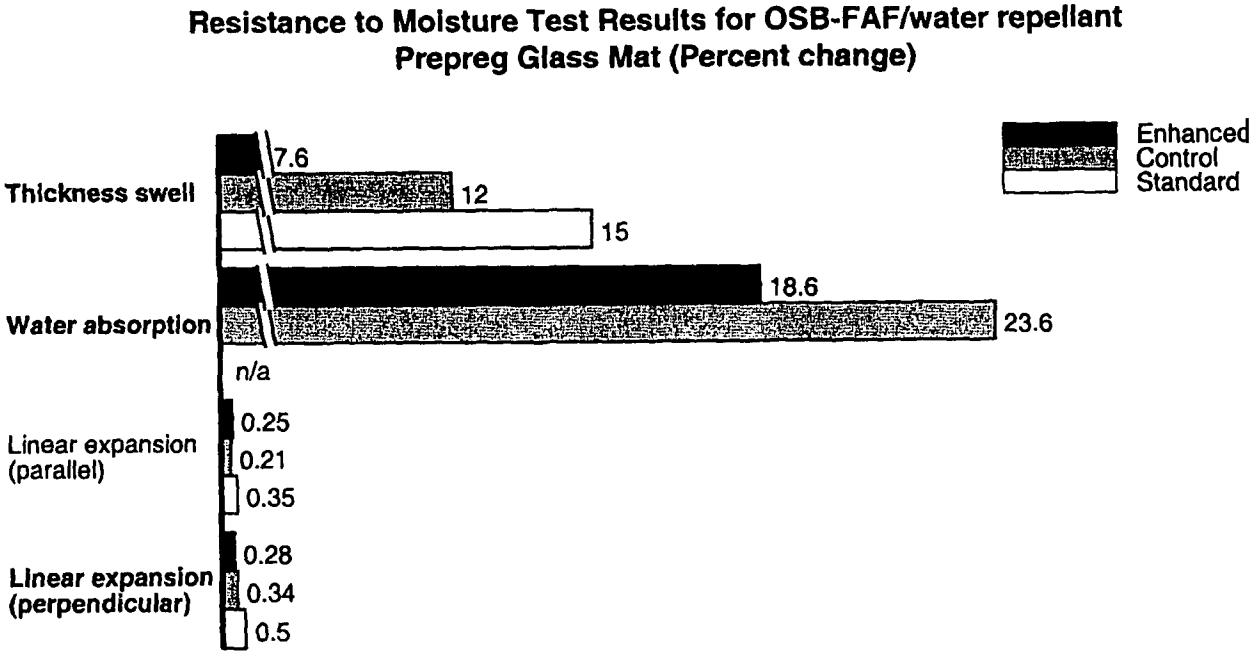
FIG. 4 illustrates the resistance to moisture test results for boards comprising OSB with glass mat facings made using FAF binder and a water repellant (Enhanced). The figure also illustrates comparative results for an OSB control (Control) that was tested as well as the Canadian Standards Association (CSA) minimum standards (Standard) for OSB for each of the tests.
Figure 5:
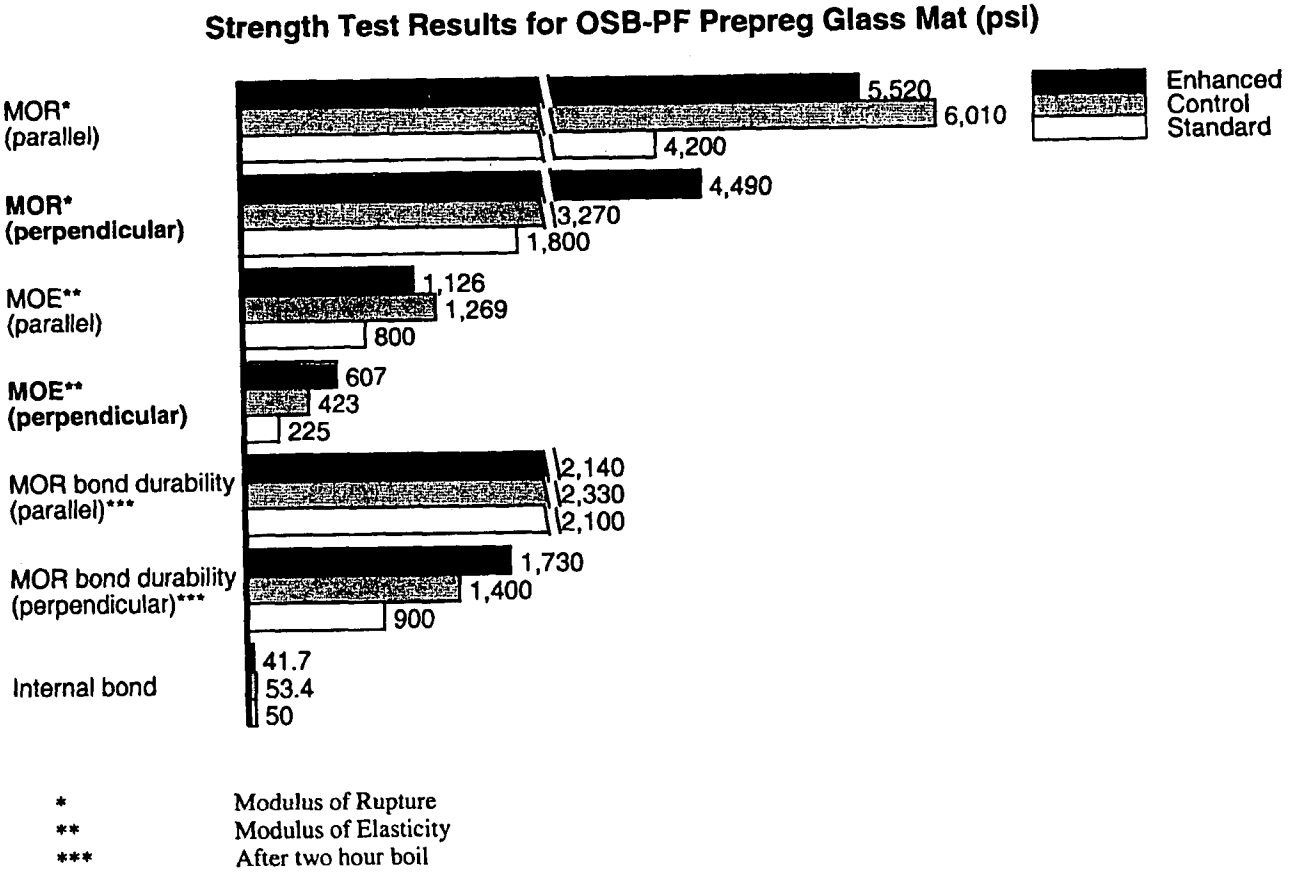
FIG. 5 illustrates strength test results for boards comprising OSB with glass mat facings that were made using phenol formaldehyde (PF) binder (Enhanced). The figure also illustrates the comparative Control and Standard values listed in FIG. 3.
Figure 6:
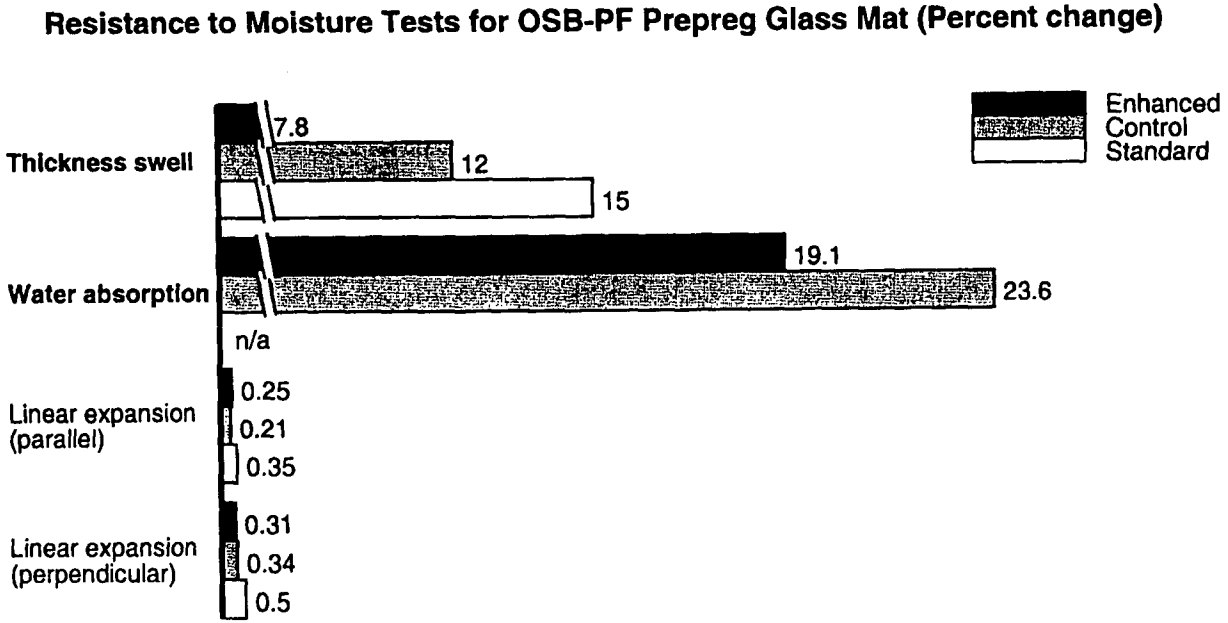
FIG. 6 illustrates the resistance to moisture test results for boards comprising OSB with glass mat facings made using PF binder (Enhanced). The figure also illustrates the comparative Control and Standard values listed in FIG. 4.
Figure 7:
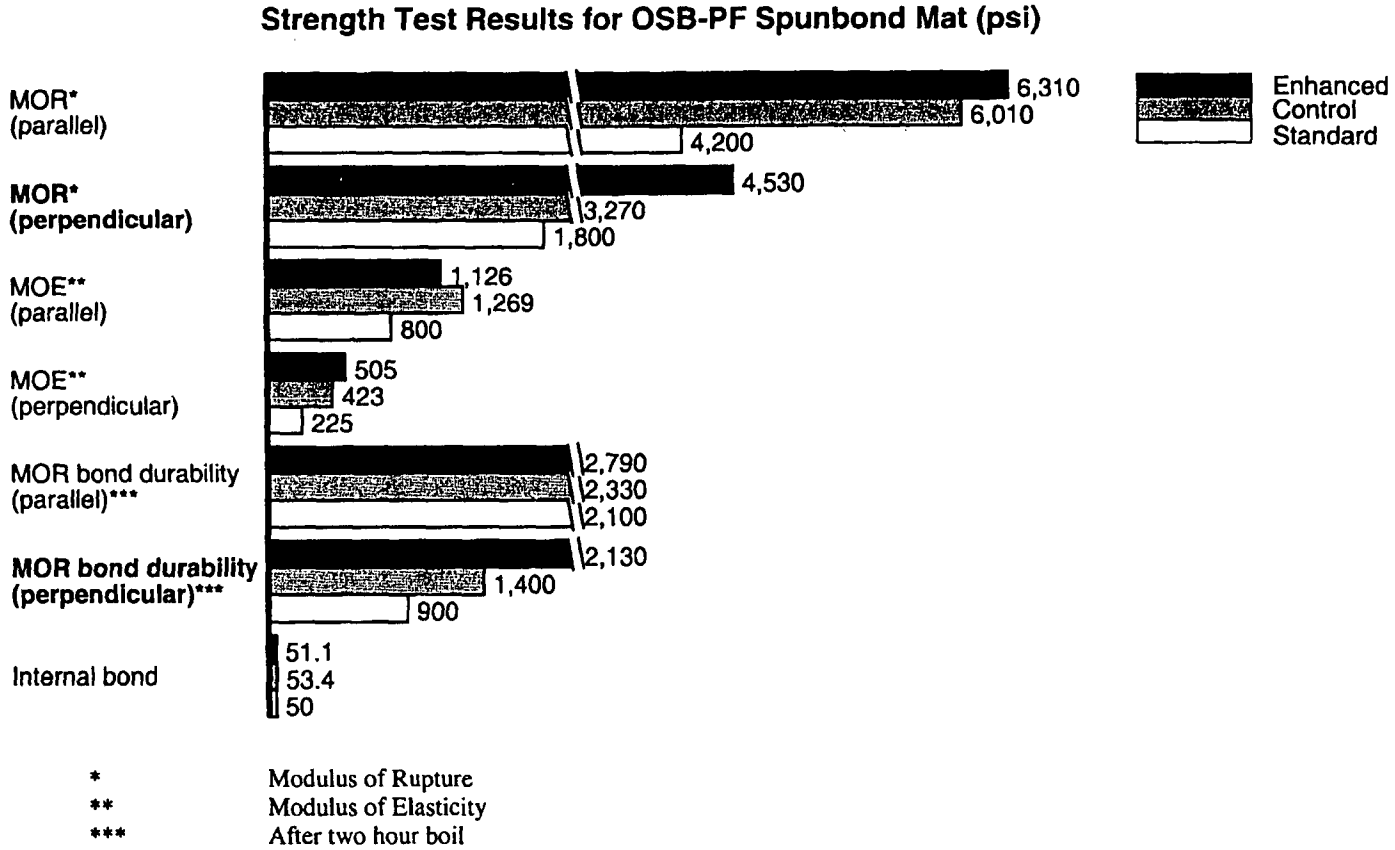
FIG. 7 illustrates the strength test results for boards comprising OSB with polyester spunbond mat facings that were made using PF binder (Enhanced). The figure also illustrates the comparative Control and Standard values listed in FIG. 3.
Figure 8:
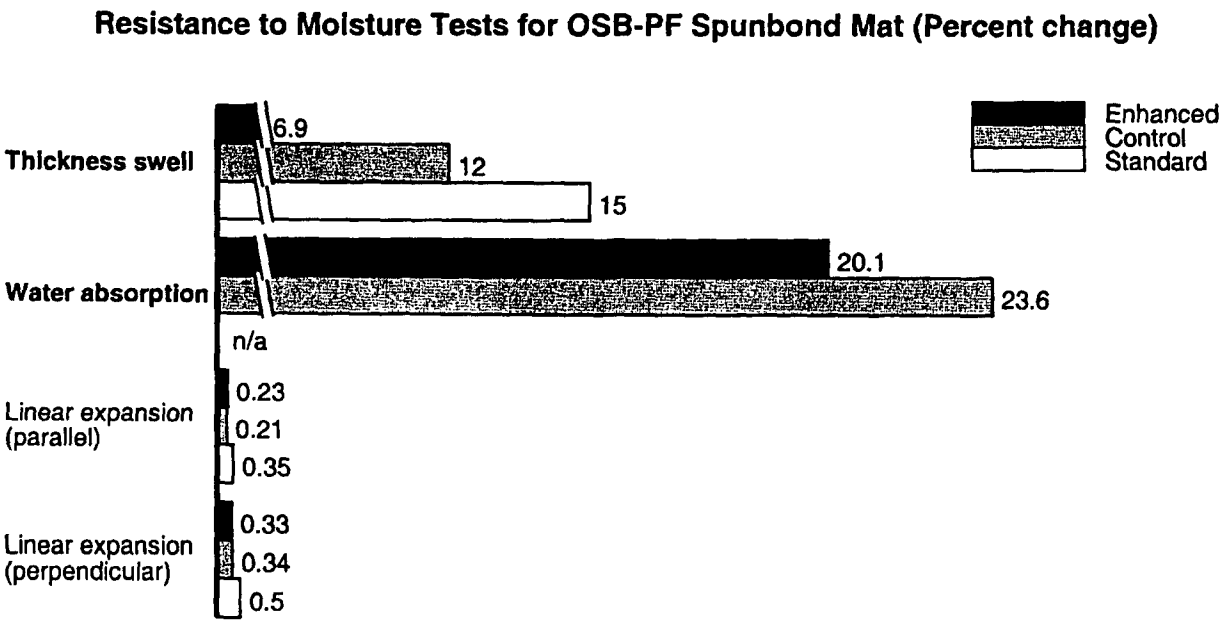
FIG. 8 illustrates the resistance to moisture test results for boards comprising OSB with polyester spunbond mat facings that were made using PF binder (Enhanced). The figure also illustrates the comparative Control and Standard values listed in FIG. 4.
Figure 9:
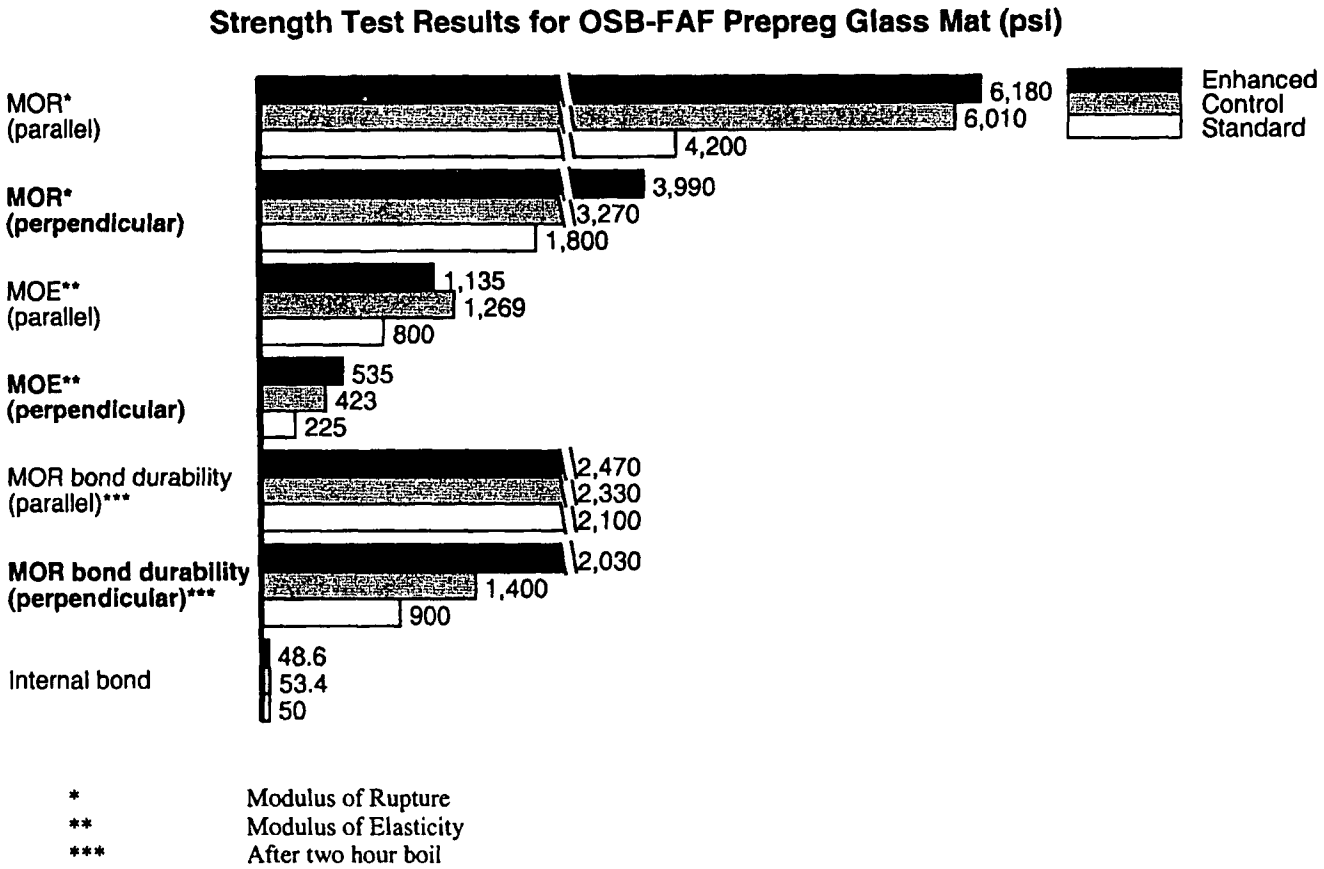
FIG. 9 illustrates the strength test results for boards comprising OSB with a glass mat facings that were made using FAF binder (Enhanced). The figure also illustrates the comparative Control and Standard values listed in FIG. 3.
Figure 10:
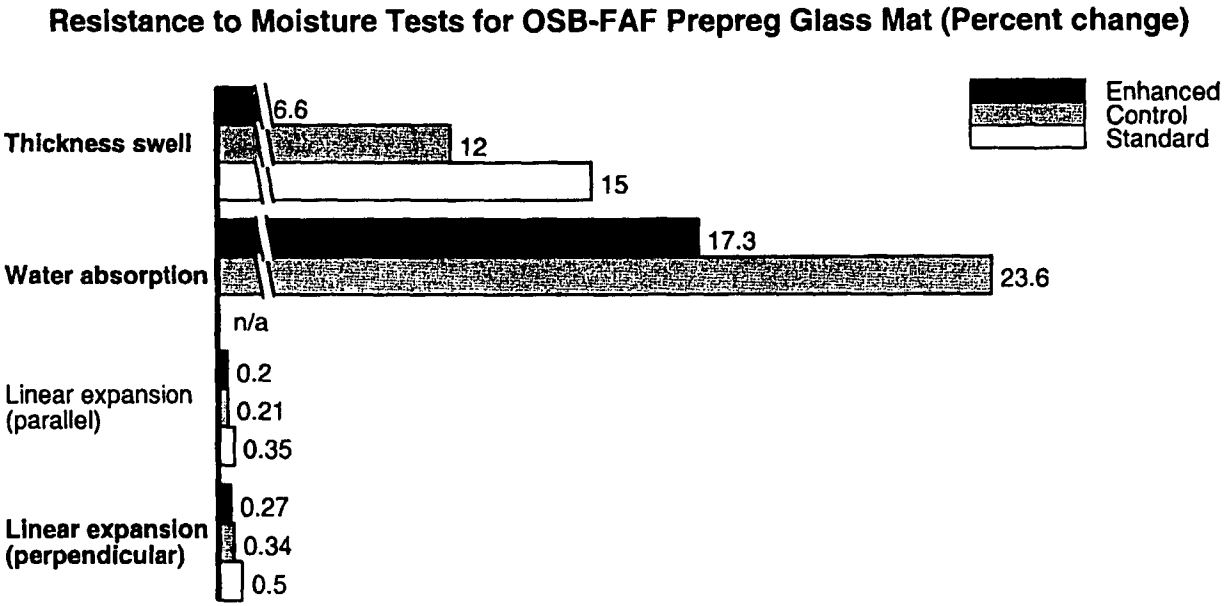
FIG. 10 illustrates the resistance to moisture test results for boards comprising OSB with glass mat facings made using FAF binder. The figure also illustrates the comparative Control and Standard values listed in FIG. 4.
Figure 11:
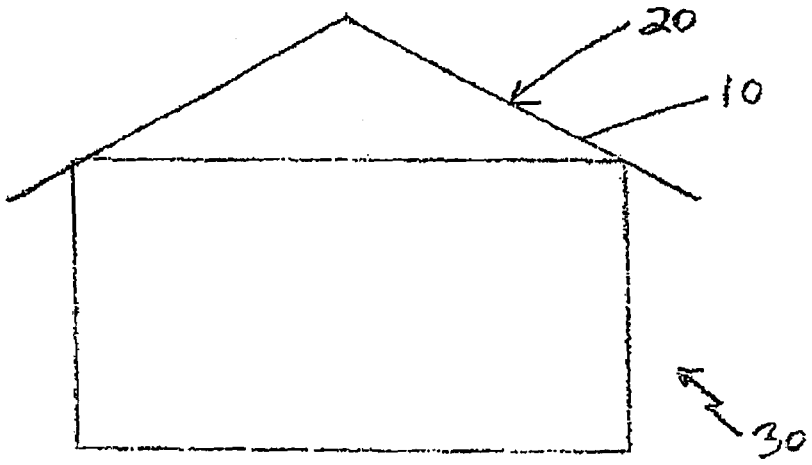
FIG. 11 is a front view generally illustrating a building with a roof structure having water resistant roof sheathing panels thereon.
Figure 12:
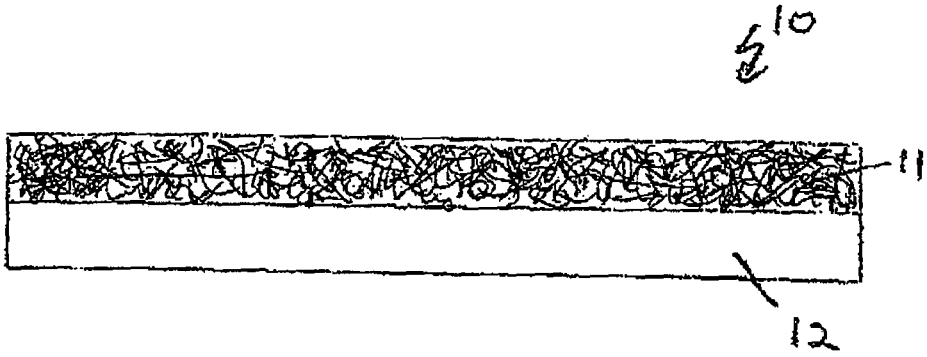
FIG. 12 is a schematic illustration of a water resistant roof sheathing panel comprising a wood sheet product and a nonwoven fabric mat adhered to the wood sheet product.
Figure 13:
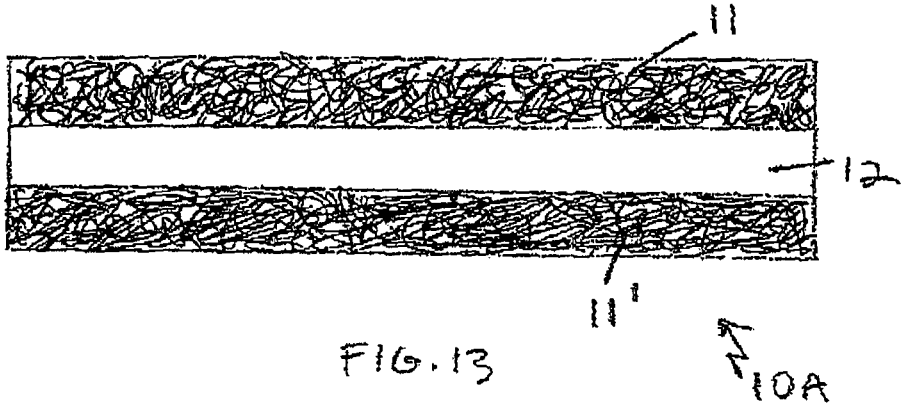
FIG. 13 is a schematic illustration of a water resistant roof sheathing panel comprising a wood sheet product and nonwoven fabric mats adhered to both faces of the wood sheet product.
Figure 14:
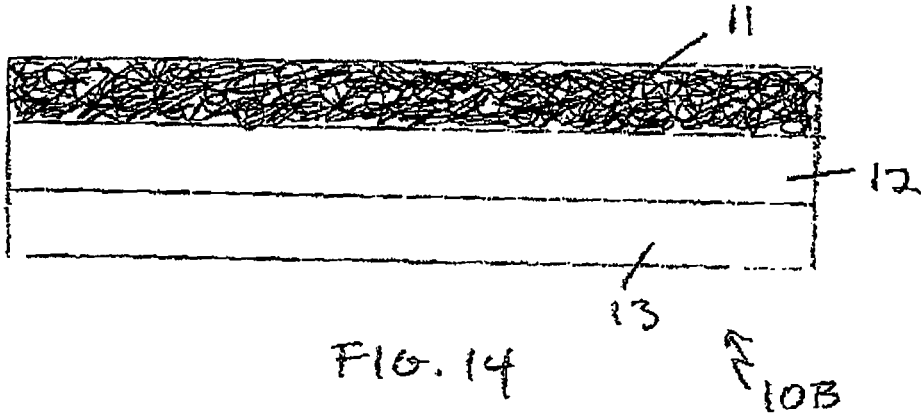
FIG. 14 is a schematic illustration of a water resistant roof sheathing panel comprising a wood sheet product, a nonwoven fabric mat adhered to the wood sheet product, and a radiant barrier adhered to the wood sheet product opposite the nonwoven fabric mat.
Figure 15:
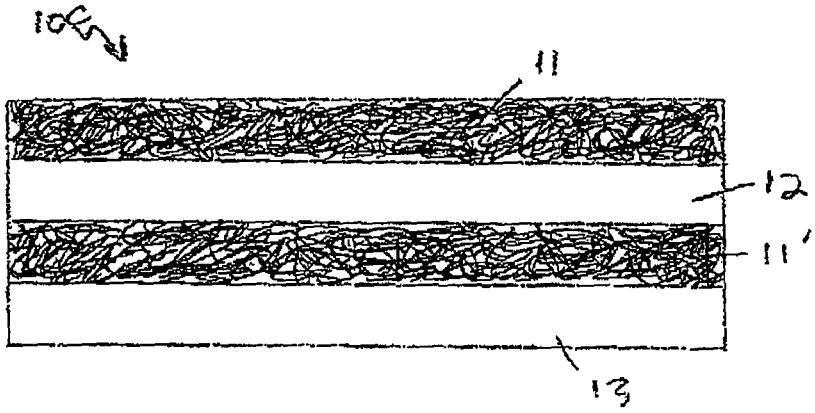
FIG. 15 is a schematic illustration of a water resistant roof sheathing panel comprising a wood sheet product, nonwoven fabric mats adhered to both faces of the wood sheet product, and a radiant barrier adhered to one of the nonwoven fabric mats.

Referring to FIGS. 11 and 12, water protection may be provided to a roof of a building by providing one or more water resistant roof sheathing panels 10 and installing the roof sheathing panel(s) 10 on a roof structure 20 of a building 30 such that the nonwoven mat 11 of each panel 10 faces outwardly from the building 30. A roof structure of a building may comprise, for example, a frame or other structure of the roof, and installation of the roof sheathing panels may comprise attaching the panels to the frame of roof structure. In some embodiments, such as the embodiments depicted in FIGS. 13 and 15, the roof sheathing panels 10A, 10C may comprise nonwoven fabric mats 11, 11' adhered to both faces of the wood sheet product 12 such that one mat 11 faces outwardly from the building and one mat 11' faces inwardly to the building. As illustrated in FIGS. 14 and 15, the roof sheathing panels 10B, 10C may also include a radiant barrier 13 attached as the interior face of the panels such that the radiant barrier 13 will face inwardly toward the building when attached to the roof structure. Such a radiant barrier may, for example, add flame resistance and thermal resistance to the sheathing panels and may limit heat transfer to the building from outside the building (e.g., from radiation from the atmosphere).

The methods of providing water protection to roof structures may further comprise attaching or installing a roofing material to or on top of the nonwoven mat of the roof sheathing panel(s) that faces outwardly from the building. The roofing material may be any type of roofing material such as, for example, clay, concrete, or metal roofing tiles, asphalt shingles, wood shakes, etc.

Each of the roof sheathing panels typically comprises two faces with at least one nonwoven fabric mat on one of the faces: FIG. 12 shows an embodiment of the roof sheathing panel 10 where one nonwoven fabric mat 11 is adhered to a face of the wood sheet product 12. FIG. 13 shows an embodiment of the roof sheathing panel 10A where two nonwoven fabric mats 11, 11' are adhered to the faces of the wood sheet product 12. As stated above, alternative embodiments of the roof sheathing panels 10B, 10C, shown in FIGS. 14 and 15, comprise a radiant barrier 13 as the second face of the roof sheathing panels 10B, 10C opposite to the at least one nonwoven fabric mat 11 such that the radiant barrier 13 faces toward the interior of the building when attached to a roof structure. In certain embodiments, like the roof sheathing panel 10B, the radiant barrier 13 may attached to a face of the wood sheet product 12. In other embodiments, like the roof sheathing panel 10C, wherein the roof sheathing panel includes a nonwoven mat 11, 11' attached to both faces of the wood sheet product 12, the radiant barrier 13 may be attached to the second nonwoven mat 11'. The radiant barrier 13 may be a metal foil sheet or may be a metal foil sheet adhered to a backing material such as, for example, kraft paper or a nonwoven fabric mat (e.g., a mat to be attached to the wood sheet product). The metal foil sheet is preferably made from aluminum, but may be made from any noncorroding metal. In addition, the metal foil sheet is preferably perforated. Radiant barrier materials are discussed in U.S. Pat. No. 5,231,814 and U.S. Patent Application Publication No. 2003/0145550.

Each roof sheathing panel can be used in low slope (roof pitch of 3:12 or lower) and steep slope applications (roof pitch higher than 3:12). In these sloped applications it is essential to provide a top surface that will be anti-skid so that installers of the roof and materials such as felts, underlayments, tiles or shingles stored on the rooftop during the installation process do not slide off the roof. Use of a high COF nonwoven on the top surface of the roof deck laminate enhances skid resistance. Additionally the upper surface of the laminate can be embossed to provide slip resistance in addition to enhancing the aesthetic appeal of the material. Embossing may be achieved during the manufacturing process by imprinting the desired emboss pattern on the composite laminate using a press roller. Another means of achieving an anti-skid surface is by coating the exposed layer with an adhesive (such as an EVA material) in the form of straight lines or in a random pattern (called "fiberized" pattern). Such external treatment provides good skid resistance on the roof. Preferred is to post apply an ethyl vinyl acetate (EVA) as an anti-skid coating on the upper side of the composite roof deck board to provide anti-slip properties. Most preferred is using a fiberized hot melt adhesive at 6 to 15 gpsm. A good ethyl vinyl acetate (EVA) anti-skid hot melt adhesive that also has excellent high temperature resistance is available, for example, from National Starch and Chemicals Company.

Figure 16:
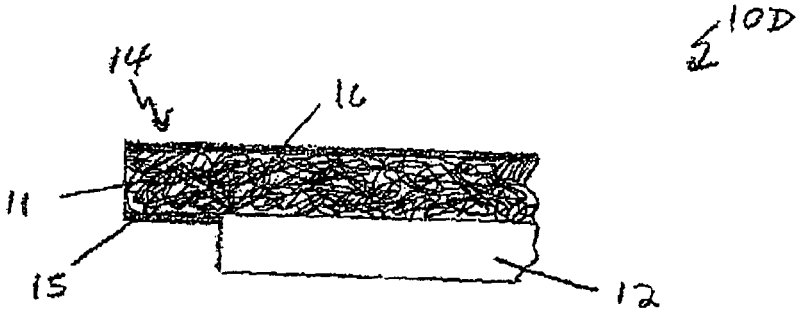
FIG. 16 is a schematic illustration of a portion of a water resistant roof sheathing panel comprising a wood sheet product, a nonwoven fabric mat adhered to the wood sheet product, an overlay portion of the nonwoven fabric mat extending beyond an edge of the wood sheet product, a pressure sensitive adhesive on the overlay portion, and an organic waterproof coating adhered to the nonwoven fabric mat opposite the wood sheet product.

Each of the roof sheathing panels further comprises outer edges. The outer edges of the roof sheathing panels may include self-adhesive tape covered by one of more strips that are removable form the self-adhesive tape. For example, the panels may include a tongue on a first outer edge and a corresponding groove on a second, opposite outer edge such that multiple panels may be connected together by interconnecting the tongues and grooves of adjacent panels. In such embodiments, the at least one mat 11,11' and the wood sheet product 12 are typically coterminous at the outer edges of the roof sheathing panel 10, 10A, 10B, 10C as depicted in FIGS. 12-15 (i.e., outer edges of the mat and wood sheet product are coterminous). In some embodiments, however, the outer edges of the wood sheet product and the at least one nonwoven mat are not coterminous. For example, as shown in FIG. 16, the at least one nonwoven fabric mat 11 of each roof sheathing panel 10D may include an overlay portion 14 extending beyond one or more edges of the wood sheet product 12 to which it is adhered. Such an overlay portion 14 may include a pressure sensitive adhesive 15. Ideally these overlay portions 14 are installed on the roof in a shingle fashion to encourage water drainage along the roof pitch. Alternatively, separate sealing tapes supplied in roll form can be used to seal joints between panels, or conventional underlayment can be applied over the panels.

When installing the roof sheathing panels with an overlay portion of nonwoven mat having a pressure sensitive adhesive, the overlay portion of one of the roof sheathing panels may be adhered to the roof structure or to another roof sheathing panel. In some embodiments, such installation may form a seal. When installing the roof sheathing panels with self-adhesive tape, the removable strip or strips may be removed from the self-adhesive tape of one of the roof sheathing panels and joined with the roof structure or with another roof sheathing panel (or self-adhesive tape on another panel) so as to form a seal. A seal between adjacent roof sheathing panels or between a roof sheathing panel and a roof structure may also be formed using a sealing material such as, for example, epoxy resin, mastic, or caulk.

In some embodiments, the methods may consist of providing the water resistant roof sheathing panel(s) and installing the panel(s) on a roof structure. That is, in such embodiments, no other water protection (such as felt paper or TriFlex 30™ underlayment) for the roof structure will be supplied. In some of these embodiments, the step of installing the roof sheathing panel(s) may include forming a seal between the edges of adjacent roof sheathing panel(s) and/or forming a seal between the edges of the roof sheathing panels and the roof structure (e.g., roof frame); however, in other of these embodiments, the step of installing the roof sheathing panel(s) may not include forming a seal between the edges of the roof sheathing panel(s).

FIG. 11 illustrates roof structures 20 formed by the methods of the present invention. The roof structures 20 generally comprise a plurality of water resistant roof sheathing panels 10 attached to a roof frame of a building 30 as a base layer. As explained above and illustrated in FIG. 12, each panel comprises a wood sheet product 12 and at least one nonwoven fabric mat 11 adhered to a face of the wood sheet product 12. The at least one nonwoven fabric mat 11 of each panel faces outwardly from the building. The roof structure also comprises a roofing material (e.g., clay, concrete or metal roofing tiles, asphalt shingles, wood shakes, etc.) attached over the nonwoven mats of the base layer of roof sheathing panels.

The wood sheet products used to form the roof sheathing panels may be any type of wood product including, but not limited to particle board, chip board, oriented strand board (OSB), plywood, and hardboard.

The nonwoven mats used to form the roof sheathing panels comprise fibers bonded together with a binder. In some embodiments, the nonwoven mats may consist of fibers and binder, and in other embodiments the nonwoven mats may include additional additives, such as pigments, dyes, flame retardants, water resistant agents, waterproofing agents, and/or other additives. Water resistant and waterproofing agents that may be used include, but are not limited to, stearylated melamine, fluorocarbons, waxes, asphalt, organic silicone, rubber, and polyvinyl chloride.

The fibers of the nonwoven mats may comprise glass fibers, polyester fibers (e.g., polyester spunbonded fibers), polyethylene terephthalate (PET) fibers, other types of synthetic fibers (e.g., nylon, polypropylene, etc.), carbon fibers, ceramic fibers, metal fibers, or mixtures thereof. The fibers in the nonwoven mats may consist entirely of one of the previously mentioned types of fibers or may comprise one or more of the previously mentioned types of fibers along with other types of fibers such as, for example, cellulosic fibers or fibers derived from cellulose. The nonwoven mat can also be reinforced, either within itself or on the surface with parallel strands, diagonal or box shaped scrim of reinforcements. These additional reinforcements may be glass yarn or continuous filaments of plastic or metal.

The fibers may have various fiber diameters and lengths dependent on the strength and other properties desired in the mat. When polyester fibers are used, it is preferred that the denier of a majority of the fibers is in the range of 3 to 5. When glass fibers are used, it is preferred that a majority of the glass fibers have diameters in the range of 6 to 23 microns, more preferably in the range from 10 to 19 microns, even more preferably in the range of 11 to 16 microns. The glass fibers can be any type of glass including E glass, C glass, T glass, S glass, and other types of glass with good strength and durability in the presence of moisture.

Various binders may be used to bond the fibers together. Typically, binders are chosen that can be put into aqueous solution or emulsion latex and that are water soluble. As explained more fully below, the binders may be completely cured when forming the nonwoven mats or the binders may be "B" staged (i.e., only partially cured). When the binder in a nonwoven mat will be "B" staged, the binders preferably bind well to wood. Examples of binders that may be used for forming nonwoven mats with "B" staged binder include, but are not limited to, a furfuryl alcohol based resin, a phenol formaldehyde resin, a melamine formaldehyde resin, and mixtures thereof. When the mats will be completely formed (i.e., the binder will not be "B" staged), the binders may include, but are not limited to urea formaldehyde, melamine formaldehyde, phenol formaldehyde, acrylics, polyvinyl acetate, epoxy, polyvinyl alcohol, or mixtures thereof. Binders may also be chosen such that the binder is "formaldehyde free", meaning that the binder contains essentially no formaldehyde (i.e., formaldehyde is not essential, but may be present as an impurity in trace amounts). Binder that may be used to provide formaldehyde free nonwoven mats include, but are not limited to polyvinyl alcohol, carboxy methyl cellulose, lignosulfonates, cellulose gums, or mixtures thereof. The nonwoven mat binder can also include a formaldehyde scavenger, which are known. Using formaldehyde scavengers in the binder dramatically slows the measurable formaldehyde release rate from the product.

Similarly, the nonwoven binder can include antimicrobial additives. Examples of suitable antimicrobial materials include zinc 2-pyrimidinethiol-1-oxide; 1-[2-(3,5-dichlorophenyl)-4-propyl-[1,3]dioxo-lan-2-ylmethyl]-1H-[1,2,4] triazole; 4,5-dichloro-2-octyl-isothiazolidin-3-one; 2-octyl-isothiazolidin-3-one; 5-chloro-2-(2,4-dichloro-phenoxy)-pheno-1,2-thiazol-4-yl-1H-benzoimidazole; 1-(4-chlorophenyl)-4,4-dimethyl-3-[1,2,4]triazol-4-ylmethyl-pentan-3-ol; 10,10' oxybisphenoxarsine; 1-(diiodo-methanesulfonyl)-4-methyl-benzene and mixtures thereof. By encapsulating or surface covering the two surfaces of the wood sheathing panel with antimicrobial skins the entire product becomes more mold and mildew resistant. The skins can also include an additive such as borates that resist termites or other pests and provides additional fire resistance.

The nonwoven fabric mats may be made with varying ratios of the amount of fiber to the amount of binder in the mat. For example, in the "B" staged mats, it is preferable that the mats contain about 25-75 weight percent fibers and about 15-75 weight percent binder, more preferably 30-60 weight percent fibers and 40-70 weight percent binder. In mats made from formaldehyde free binder, it is preferred that the mats contain about 93-99.5 weight percent fibers and about 0.5-4 weight percent binder. However, other ratios of fiber to binder in the mats may be used for "B" staged mats, formaldehyde free mats, as well as non-"B" staged mats and other mats.

The nonwoven fabric mats may also be made to have varying thicknesses. Typical thicknesses for the mats range from 0.020 inches to 0.125 inches, although thicker and thinner mats may be used.

The nonwoven mats may include a coating to impart water resistance (or waterproofness), flame resistance, insect resistance, mold resistance, a smooth surface, increased or reduced surface friction, desirable asethetics, and/or other surface modifications. Coatings that may be used for waterproofing include organic waterproof coatings such as asphalt, organic silicone, rubber, and polyvinyl chloride. The coatings are preferably on the exterior side of the mats (i.e. the side that is not bound to the wood sheet product). As an example, FIG. 16 shows a nonwoven mat 11 having an organic waterproof coating 16 on the exterior side of the mat incorporated into a water resistant roof sheathing panel 10D of the present invention.

Any method for making nonwoven fabric mats may be used to provide the mats. Processes for making nonwoven fabric mats are well known. U.S. Pat. Nos. 4,112,174, 4,681,802 and 4,810,576, the entire contents of which are hereby incorporated herein by reference, describe methods of making nonwoven glass fabric mats.

One technique for making the nonwoven mats that may be used is forming a dilute aqueous slurry of fibers and depositing the slurry onto an inclined moving screen forming wire to dewater the slurry and form a wet nonwoven fibrous mat, on machines like a Hydroformer™ manufactured by Voith-Sulzer of Appleton, Wis., or a Deltaformer™ manufactured by Valmet/Sandy Hill of Glenns Falls, N.Y. After forming a web from the fibrous slurry, the wet, unbonded mat is transferred to a second moving screen running through a binder application saturating station where the binder in aqueous solution is applied to the mat. The aqueous binder solution is preferably applied using a curtain coater or a dip and squeeze applicator. The excess binder is removed, and the wet mat is transferred to a moving oven belt that runs through a convection oven where the unbonded, wet mat is dried and cured, bonding the fibers together in the mat. The mat may be fully cured or may be cured to only a "B" stage. In the drying and curing oven the mat is heated to temperatures of up to about 350 degrees F., but this can vary from about 210 degrees F. to as high as any temperature that will not deteriorate the binder or, when a "B" stage cure is desired, to as high as any temperature that will not cure the binder beyond "B" stage cure. The treatment time at these temperatures can be for periods usually not exceeding 1 or 2 minutes and frequently less than 40 seconds. When curing the binder to a "B" stage, the lower the temperature that is used for the cure, the longer time required to reach "B" stage cure, although a temperature is normally selected such that the binder will reach "B" stage cure in no more than a few seconds.

The roof sheathing panels may be formed from the nonwoven fabric mats and the wood sheet products by attaching a nonwoven fabric mat to a face of a wood sheet product. The nonwoven fabric mat may be attached to a wood sheet product either after completion of manufacture of the wood sheet product or during manufacture of the wood sheet product. When using a completed wood sheet product and a nonwoven mat that has been completely cured (i.e., when the nonwoven mat is not in a "B" stage condition), an adhesive may be used to adhere the completed wood sheet product and the nonwoven mat together using sufficient pressure and heat to cure the adhesive. When using a completed wood sheet product and a nonwoven mat that is in a "B" stage condition, the completed wood sheet product and the nonwoven mat with a "B" stage condition binder are placed in contact and then subjected to sufficient heat and pressure to adhere the mat to the wood sheet product and to finish curing the "B" staged binder in the mat.

The roof sheathing panels may also be formed during manufacture of a wood sheet product such as OSB that comprises wood particles bonded together with binder using elevated heat and pressure. During formation of such a wood sheet product, a furnish comprising a mixture of wood particles and binder is formed into an oriented or nonoriented mat, which is then subjected to sufficient heat and pressure to cure the binder and form the completed wood sheet product. The particles may be in any form including, but not limited to, chips, shavings, fibers, flakes, wafers, strands, and combinations thereof. The binder used to bond the wood particles together may be any binding agent that binds the particles together to form the wood sheet product when subjected to heat and pressure including, for example, phenol formaldehyde resin, urea formaldehyde resin, melamine formaldehyde resin, and the like.

In order to form a roof sheathing panel during manufacture of a wood sheet product (rather than after completion of the wood sheet product), a composite mat is formed using at least one nonwoven fabric mat and a furnish comprising wood particles and a binder. The composite mat comprises (1) a mat formed from the furnish having a first face and a second face and (2) the nonwoven fabric mat contacting the first face of the mat formed from the furnish. When two nonwoven fabric mats are used with the furnish to form the composite mat, the composite mat may comprise (1) a mat formed from the furnish having a first face and a second face, (2) a first nonwoven fabric mat contacting the first face of the mat formed from the furnish, and (3) a second nonwoven fabric mat contacting the second face of the mat formed from the furnish. The composite mat could be formed by forming the mat from the furnish and then contacting the at least one nonwoven fabric mat to one of the faces of the mat formed from the furnish, or the composite mat could be formed by forming the mat from the furnish while the furnish is in contact with the at least one nonwoven fabric mat such that the nonwoven fabric mat is in contact with a face of the resulting mat formed from the furnish. After being formed, the composite mat is subjected to sufficient heat and pressure to form a roof sheathing panel comprising a wood sheet product having a first face, a second face, and edges (made from the mat formed from the furnish) and the nonwoven fabric mat or mats adhered to the face or faces of the wood sheet product. That is, the composite mat is subjected to sufficient heat and pressure to form the completed/cured wood sheet product from the mat formed from the furnish as well as to adhere the nonwoven mat thereto. Thus, only one application of heat and pressure is used, rather than forming the wood sheet product using a first application of heat and pressure and then performing a second application of heat and pressure to adhere a nonwoven fabric mat to the wood sheet product. The press times, temperatures, and pressures used to form the roof sheathing panel may vary depending upon the desired thickness and density of the panel, the binder or binders that are used, as well as other variable factors.

When a roof sheathing panel is formed using a one-step application of heat and pressure to a composite mat, "B" staged nonwoven fabric mats or fully cured nonwoven fabric mats may be used to form the roof sheathing panel. When a "B" staged nonwoven fabric mat is used in the composite mat, no additional binder or adhesive is typically needed to adhere the nonwoven mat to the wood sheet product during the one-step application of heat and pressure (although such additional binder or adhesive may be used if desired); the pressure and heat that the composite mat is subjected to is sufficient to complete the cure of the binder in the "B" staged nonwoven mat and adhere the nonwoven fabric mat to the wood sheet product. When a nonwoven fabric mat is used that has been completely cured (i.e., when the nonwoven mat is not in a "B" stage condition), additional binder or adhesive may be used to adhere the nonwoven mat to the wood sheet product that is formed during the one-step application of heat and pressure; the pressure and heat that the composite mat is subjected to is sufficient to complete the cure of the additional binder or adhesive and adhere the nonwoven mat to the completed wood sheet product. Such additional adhesive or binder may be added between the mat formed with the furnish (i.e., the mat comprising wood particles and binder) and the nonwoven fabric mat, may be added to the furnish before forming the mat with the furnish, or may be added to the nonwoven fabric mat.

Methods of making "B" staged nonwoven mats as well as wood laminates using "B" stage nonwoven mats are described in U.S. Pat. Nos. 5,837,620; 6,331,339; and 6,303,207 and U.S. Patent Application Publication No. 2001/0021448, the entire contents of which are incorporated by reference herein. Methods of making nonwoven mats using formaldehyde free binders as well as wood laminates using such mats are described in U.S. Patent Application Publication No. 2003/0008586, the entire content of which is incorporated by reference herein.

The nonwoven fabric mats to be used in the roof sheathing panels are chosen such that they provide water resistance to the sheathing panels. As used herein, "water resistance" of a roof sheathing panel and a "water resistant" roof sheathing panel mean that the water resistance of the roof sheathing panel is greater than (1) the water resistance of the wood sheet product of the roof sheathing panel alone (i.e., without the one or more nonwoven fabric mats adhered to the wood sheet product) and/or (2) the water resistance of a wood sheet product of the same type used in the roof sheathing panel with comparable dimensions to the completed roof sheathing panel (i.e., the same size as the roof sheathing panel). Such water resistance may be added to the roof sheathing panels in a variety of ways such as, for example, (1) by the binder in the nonwoven mat, (2) by a water repellant coating (or a waterproof coating) on the nonwoven mat, (3) by a water repellant agent (or waterproof agent) added with the binder when forming the nonwoven mat, and/or (4) by addition of water repellant (or waterproof fibers (such as polyester fibers) to the nonwoven mat. Other methods of adding water repellency to the mats of the roof sheathing panels may also be used. The addition of water resistance to the roof sheathing panels may also add or increase the mold and mildew resistance of the roof sheathing panels.

In addition, the nonwoven fabric mats may increase the strength (e.g., flexural strength), dimensional stability, and/or flame resistance of the roof sheathing panels as compared to the wood sheet product of the panels alone. That is, the nonwoven fabric mat(s) may be chosen such that one or more of these properties in the roof sheathing panel is greater than that of the wood sheet product of the roof sheathing panel without the one or more nonwoven fabric mats adhered to the wood sheet product.

Furthermore, the nonwoven fabric mats to be used in the roof sheathing panels may also be chosen such that they provide increased strength (e.g., flexural strength or puncture resistance), increased dimensional stability, increased mold resistance, increased flame resistance, and/or reduced weight to the roof sheathing panel as compared to a wood sheet product of the same type used in the roof sheathing panel with comparable dimensions to the completed roof sheathing panel (i.e., as compared to a wood sheet product the same size as the roof sheathing panel).

Further, the increased stiffness of the new roof decking with top and bottom nonwoven skins permits the spacing between roof joists to be increased while maintaining a flat roof that is load bearing, stays flat with no waviness and does not transmit picture windowing. Alternatively, the user can select a thinner grade of decking with the original roof joist spacing. The stressed skins also reduce the amount of swelling that occurs through physical constraint on the edge. This overcomes a problem with common exterior OSB whose unsealed edges, or cut edges, suck up water and swell causing an uneven and visually unacceptable roof surface.

Also, covering one or both sides of the wood deck sheathing with nonwoven skins composed of primarily inorganic fibers enhances the fire penetration resistance and reduces flame propagation. Reduced flame propagation is especially desirable on the underside where the sheathing is exposed in attics or open to an air wash such as in ventilated cathedral ceilings. Additional advantages are also realized as each nonwoven skin applied to the wood sheathing boards aids to significantly reduce flaking and dust. A double side skinned sheathing board is considered to exhibit no flaking compared to a standard OSB.

Surface finish of the top and bottom of these sheathing boards can be significantly modified by selecting different nonwoven facers. A typical OSB is sanded to produce a smooth surface whereas a nonwoven B staged glass mat facer normally generates a smooth surface with no sanding.

EXAMPLE

The invention will be further explained by the following illustrative example that is intended to be non-limiting.

Various types of test boards were manufactured and tested in order to measure their strength and moisture resistance. Briefly, the test boards comprised an oriented strand board with nonwoven fabric mats adhered to the faces of the board. Oriented strand board (OSB) without nonwoven fabric mats was used as a control and was tested for the same properties as the test boards.

A. Boards

The following types of boards were tested, with the number of boards manufactured listed in parentheses after the description of the type of board:

(1) OSB with glass mat facings made using furfuryl alcohol formaldehyde (3 boards manufactured);

(2) OSB with glass mat facings made using furfuryl alcohol formaldehyde with stearylated water repellant added to the binder (2 boards manufactured);

(3) OSB with glass mat facings made using phenol formaldehyde binder (2 boards manufactured);

(4) OSB with polyester spunbonded mat facings made using phenol formaldehyde binder (2 boards manufactured); and (5) OSB with no nonwoven mat facing (i.e., the control) (2 boards manufactured).

The "B" staged nonwoven mats used for the boards were formed using a conventional wet lay process. The basis weight of the glass mats used with the test samples was 6 lbs./100 ft.$^2$, with the mats made with approximately 60% binder and 40% fibers. The glass fibers used in the glass mats were E glass fibers having average fiber diameters of 16 microns and an average length of 1 inch. In the glass mats with stearylated water repellant added to the binder, the mats were made with approximately 40% fibers, 56% binder, and 4% water repellant. The basis weight of the polyester spunbonded mats were 120 g/m$^2$, with the phenol formaldehyde binder applied at 3 lbs./100 ft$^2$. The polyester spunbond fiber used in the mats had a denier of approximately 4 dpf.

The test boards and the oriented strand board control boards were prepared using a 34"×34" forming box. To form the OSB control boards, the furnish of wood strands and binder was hand formed into mats using the forming box. To form the test boards, the furnish of wood strands and binder and the "B" staged nonwoven mats were hand formed into composite mats using the forming box such that the nonwoven mats sandwiched a mat formed by the furnish. The hand formed mats were then pressed using a typical OSB press cycle. All parameters were based on typical OSB commercial values as summarized in the table below.

| | |
|---|---|
| Target Dimensions (inches) | 28 × 28 × 0.437 |
| Target Density (lbs./ft.$^{3)}$ | 39.0 |
| Mat Construction | Oriented<br>Face/core ratio - 50/50 |

-continued

| | |
|---|---|
| Resin Type | Face: Liquid Phenol Formaldehyde<br>Core: Isocyanate resin (MDI) |
| Wax Type | Slack Wax 1% solids |
| Press Temperature (degrees Fahrenheit | 400 |

The panels were pressed to the target thickness of 0.437". The panels were pressed for approximately 150 seconds at a press temperature of 400° F. The resulting boards were trimmed to approximately 28"×28".

B. Measurements

Each type of test board and the control boards were measured for the following properties in order to assess strength and moisture resistance, with the number of samples per board that were tested listed in parentheses after the description of the test:

(1) modulus of rupture (MOR) in the parallel direction of the OSB (MOR para), measured in pounds per square inch (psi) (3 samples per board tested);

(2) modulus of rupture in the perpendicular direction of the OSB (MOR perp), measured in psi (3 samples per board tested);

(3) modulus of elasticity (MOE) in the parallel direction of the OSB (MOE para), measured in psi (3 samples per board tested);

(4) modulus of elasticity in the perpendicular direction of the OSB (MOE perp), measured in psi (3 samples per board tested);

(5) internal bond, measured in psi (6 samples per board tested);

(6) bond durability in the parallel direction of the OSB measured as the modulus of rupture after 2 hours of boiling a sample of a board, measured in psi (3 samples per board tested);

(7) bond durability in the perpendicular direction of the OSB measured as the modulus of rupture after 2 hours of boiling a sample of a board, measured in psi (3 samples per board tested);

(8) thickness swell percentage after 24 hours of soaking a sample of a board in water (2 samples per board tested);

(9) water absorption after 24 hours of soaking a sample of a board in water, measured as percentage (2 samples per board tested);

(10) linear expansion in the parallel direction of the OSB from oven dry to saturated using a vacuum pressure soak, measured as percentage (2 samples per board tested);

(11) linear expansion in the perpendicular direction of the OSB from oven dry to saturated using a vacuum pressure soak, measured as percentage (2 samples per board tested); and

(12) water vapor transmission, measured in perms (2 samples per board tested).

Each of properties (1)-(11) listed above was evaluated using Canadian Standards Association (CSA) test standard 0437.1-93. Water vapor transmission (i.e., property (12) above) was measured using ASTM Standard Test Method E96.

C. Results

The results of the measurements of the properties of the various boards are shown in FIG. 1. FIG. 1 lists the results of the tests, the standard deviation (sd) of the tests, and an indication of whether the results for each type of board were improved versus the control sample (i.e., OSB Baseline) at a statistically significant level (i.e., a 95% confidence level)

using the Student's T-test (indications were given as True or False). FIG. 1 also includes an indication for the modulus of rupture (MOR) and the modulus of elasticity (MOE) tests of whether the reduction in variation between the results for each type of board and the variation of the results for the control sample boards (i.e., OSB Baseline) for these tests were statistically significant with 95% confidence level using a Chi-Square test (indications were given as True or False, with True being an indication that the variation in the test results were reduced at a statistically significant level as compared to the variation in the OSB control boards). Finally, FIG. 1 also lists for some of the tests the CSA standard minimum for OSB.

The results illustrate increased strength and moisture resistance in the test boards. FIG. 2 summarizes the results showing the statistically significant improvements that were made to the perpendicular force strength and water resistance in the test boards versus the OSB control boards.

FIGS. 3-10 illustrate the strength and resistance to moisture test results for the test boards. The test descriptions listed in bold type indicate those tests where the listed test boards had a statistically significant difference from the control boards at the 95% confidence level.

While the invention has been described in detail and with reference to specific embodiments thereof, it will be apparent to one skilled in the art that various changes and modifications can be made without departing from the spirit and scope of the invention.

What is claimed is:

1. A method of providing water protection to a roof structure of a building comprising the steps of:

(a) providing one or more water resistant roof sheathing panels, each panel comprising a wood sheet product and a nonwoven fabric mat adhered to the wood sheet product, wherein the nonwoven fabric mat comprises fibers bonded together with a fully cured resin binder, wherein the nonwoven fabric mat is produced from a "B" stage condition partially cured nonwoven fabric mat having a resin binder only partially cured, and subjecting the "B" stage condition partially cured nonwoven fabric mat to sufficient heat and pressure to complete the cure of the binder in the mat and to adhere the mat to the wood sheet product; and (b) installing the one or more roof sheathing panels on a roof structure of a building such that the nonwoven mat of each panel faces outwardly from the building.

2. The method of claim 1 wherein the nonwoven fabric mat is selected from the group consisting of a glass fiber nonwoven mat and a polyester fiber nonwoven mat.

3. The method of claim 1, wherein the nonwoven fabric mat of each roof sheathing panel includes an overlay portion extending beyond an edge of the wood sheet product to which it is adhered, the overlay portion including a pressure sensitive adhesive.

4. The method of claim 3, wherein step (b) further comprises adhering the overlay portion of one of the roof sheathing panels with the roof structure or with another roof sheathing panel using the pressure sensitive adhesive of the overlay portion so as to form a seal.

5. The method of claim 1, wherein the each panel further comprises a radiant barrier adhered to the wood sheet product such that the radiant barrier of each of the panels faces inwardly to the building when installed on the roof structure.

6. The method of claim 1, wherein the wood sheet product is selected from the group consisting of OSB, particle board, chip board, plywood, and hardboard.

7. The method of claim 1, wherein the resin binder is selected from the group consisting of a furfuryl alcohol based resin, a phenol formaldehyde resin, a melamine formaldehyde resin, and mixtures thereof.

8. The method of claim 1, wherein the nonwoven fabric mat comprises a fungicide, pesticide, fire retardant or mixture thereof.

9. A roof structure of a building comprising:

(1) a plurality of water resistant roof sheathing panels attached to a roof frame of a building as a base layer, each panel comprising a wood sheet product and a nonwoven fabric mat adhered to the wood sheet product, wherein the nonwoven fabric mat comprises fibers bonded together with a fully cured resin binder, wherein the nonwoven fabric mat is produced from a "B" stage condition partially cured nonwoven fabric mat having a resin binder only partially cured, and subjecting the "B" stage condition partially cured nonwoven fabric mat to sufficient heat and pressure to complete the cure of the binder in the mat and to adhere the mat to the wood sheet product, and wherein the nonwoven mat of each panel faces outwardly from the building; and (2) a roofing material attached over the nonwoven mats of the base layer of the roof sheathing panels.

10. A method of providing water protection to a roof structure of a building comprising the steps of:

(a) providing one or more water resistant roof sheathing panels, each panel comprising:

a wood sheet product;

a nonwoven fabric mat adhered to the wood sheet product, the nonwoven fabric mat comprised of a resin binder and fibers, and the resin binder being fully cured; and an organic waterproof coating adhered to the nonwoven fabric mat; and (b) installing the one or more roof sheathing panels on a roof structure of a building such that the coated mat of each panel faces outwardly from the building.

11. The method of claim 10, wherein the nonwoven fabric mat is selected from the group consisting of a glass fiber nonwoven mat and a polyester fiber nonwoven mat.

12. The method of claim 10, wherein the nonwoven fabric mat of each roof sheathing panel includes an overlay portion extending beyond an edge of the wood sheet product to which it is adhered, the overlay portion including a pressure sensitive adhesive.

13. The method of claim 12, wherein step (b) further comprises adhering the overlay portion of one of the roof sheathing panels with the roof structure or with another roof sheathing panel using the pressure sensitive adhesive of the overlay portion so as to form a seal.

14. The method of claim 10, wherein the mat comprises a glass fiber nonwoven mat and the one or more sheathing panels are produced by subjecting a wood sheet product and a "B" stage condition nonwoven fabric mat having a resin binder only partially cured to sufficient heat and pressure to complete the cure of the binder in the mat and to adhere the mat to the wood sheet product.

15. The method of claim 10, wherein the mat comprises a glass fiber nonwoven mat consisting of glass fibers bonded together with a formaldehyde free binder.

16. The method of claim 10, wherein the organic waterproof coating is selected from the group consisting of asphalt, organic silicone, rubber, and polyvinyl chloride.

17. The method of claim 10, wherein the each panel further comprises a radiant barrier adhered to the wood sheet product such that the radiant barrier of each of the panels faces inwardly to the building when installed on the roof structure.

18. A roof structure of a building comprising:

(1) a plurality of water resistant roof sheathing panels attached to a roof frame of a building as a base layer, each panel comprising:

a wood sheet product, a nonwoven fabric mat adhered to the wood sheet product, the nonwoven fabric mat comprised of a binder and fibers, and an organic waterproof coating adhered to the nonwoven fabric mat, wherein the waterproof coating of each panel faces outwardly from the building; and (2) a roofing material attached over the coated mats of the base layer of roof sheathing panels.

19. A method of providing water protection to a roof structure of a building comprising the steps of:

(a) providing one or more water resistant roof sheathing panels, each panel comprising a wood sheet product and a nonwoven fabric mat adhered to the wood sheet product, wherein each panel is produced by:

(1) forming a composite mat comprising:

(i) a mat formed from a furnish comprising wood particles and a binder, the mat having a first face and a second face; and (ii) a nonwoven fabric mat contacting the first face of the mat formed from the furnish; and (2) subjecting the composite mat to sufficient heat and pressure to form a roof sheathing panel comprising a wood, sheet product having a first face, a second face, and edges with the nonwoven fabric mat adhered to the first face of the wood sheet product; and (b) installing the one or more roof sheathing panels on a roof structure of a building such that the nonwoven mat of each panel faces outwardly from the building.

* * * * *